US005584324A

United States Patent [19]

Franke et al.

[11] Patent Number: 5,584,324

[45] Date of Patent: Dec. 17, 1996

[54] AUTOMATED PRODUCT DRAINING METHOD FOR A PACKAGING MACHINE

[75] Inventors: Rickard Franke, Dalby, Sweden; Per Brandstrom, Lake Zurich, Ill.; Yutaka Kaneko, Wheeling, Ill.; Bengt Andersson, Buffalo Grove, Ill.

[73] Assignee: Tetra Laval Holdings & Finance S.A., Pully, Switzerland

[21] Appl. No.: 315,957

[22] Filed: Sep. 30, 1994

[51] Int. Cl.[6] ..... B65B 3/00

[52] U.S. Cl. ..... 141/1; 141/87; 141/128

[58] Field of Search ..... 141/1, 86, 87, 141/89–92, 115–117, 121–123; 49/360, 477.1, 507

[56] References Cited

U.S. PATENT DOCUMENTS

| | | | |
|---|---|---|---|
| 1,004,623 | 1/1911 | Bodman . | |
| 1,835,676 | 12/1931 | Scholz et al. . | |
| 2,071,006 | 2/1937 | Urschel . | |
| 2,140,811 | 12/1938 | Poole . | |
| 2,141,618 | 12/1938 | Roge | 141/128 |
| 2,330,220 | 9/1943 | Kemper . | |
| 2,838,077 | 6/1958 | Cooper | 141/82 |
| 3,087,517 | 4/1963 | Magnuson et al. | 141/1 |
| 3,195,585 | 7/1965 | Fechheimer | 141/1 |
| 3,302,333 | 2/1967 | Ganzinotti et al. . | |
| 3,339,785 | 9/1967 | Nugent . | |
| 3,694,962 | 10/1972 | McDonald et al. . | |
| 3,716,083 | 2/1973 | Tuma et al. | 141/90 |
| 3,964,526 | 6/1976 | Sindermann | 141/90 |
| 4,213,795 | 7/1980 | Ernstsson et al. | 141/91 |
| 4,228,135 | 10/1980 | Wolff . | |
| 4,335,075 | 6/1982 | Kackos . | |
| 4,396,044 | 8/1983 | Ahlers | 141/90 |
| 4,446,674 | 5/1984 | Inada | 53/502 |
| 4,527,377 | 7/1985 | Hayashi et al. | 53/167 |
| 4,836,420 | 6/1989 | Kromrey | 222/148 |
| 4,905,744 | 3/1990 | Siegrest et al. | 141/117 X |
| 4,964,444 | 10/1990 | Hanerus et al. | 141/90 |
| 4,967,813 | 11/1990 | Ponvianne et al. | 141/128 |
| 5,002,101 | 3/1991 | McLeod | 141/86 X |
| 5,094,278 | 3/1992 | Arao et al. | 141/116 X |
| 5,095,958 | 3/1992 | Tincati | 141/91 |
| 5,163,486 | 11/1992 | Rogers et al. | 141/89 |
| 5,176,189 | 1/1993 | Perchthaler et al. . | |
| 5,215,128 | 6/1993 | Neeser | 141/91 X |
| 5,246,041 | 9/1993 | Wiese . | |
| 5,333,653 | 8/1994 | Rzesutock et al. . | |
| 5,348,058 | 9/1994 | Ruhl | 141/1 |

*Primary Examiner*—J. Casimer Jacyna
*Attorney, Agent, or Firm*—McAndrews, Held & Malloy, Ltd.; Patrick N. Burkhart

[57] ABSTRACT

A clean, automated product draining method for a packaging machine is set forth. The method includes the following steps: draining product from a product tank through a filling tube; and controlling a rate at which the product is drained from the product tank with a dispensing mechanism, wherein the product is drained at a slower rate than a rate at which the product is dispensed into a container during a production cycle.

14 Claims, 4 Drawing Sheets

AUTOMATED PRODUCT DRAINING METHOD FOR A PACKAGING MACHINE

TECHNICAL FIELD

The present invention relates to an automated product draining method for a packaging machine. More specifically, the present invention relates to a clean, automated product draining method for a packaging machine.

BACKGROUND

Packaging machines are known that integrate into a single unit the various components necessary to form a container, fill the container with a liquid product, and seal the container. Such packaging machines typically feed carton blanks into the machine, seal the bottoms of the cartons, fill the cartons with a product dispensed from a product storage tank through a filling tube, seal the tops of the cartons, and off-load the filled cartons for shipping.

Where the liquid product dispensed into the cartons is a liquid foodstuff it may be necessary to maintain a sterile filling environment. The sterile filling environment must be maintained in the product storage tank, the filling tube, and in a region surrounding a terminus of the filling tube from which the product is dispensed. The region surrounding the terminus of the filling tube can be partially enclosed, for example, by a casing. Further, the sterile filling environment must be maintained in an area below the terminus of the filling tube, extending as far below the terminus as is necessary to ensure that non-sterile air is effectively prevented from penetrating the area surrounding the terminus of the filling tube.

In order to prevent bacteria from forming in parts of the packaging machine that come into contact with certain liquid foodstuffs it is known to circulate a cleaning fluid through those parts. However, any liquid product remaining in the product tank at the end of the production cycle must be drained from the product tank before the cleaning cycle can begin.

Typically, the remaining product is drained from the product tank by opening the pump valves in the system such that the remaining product flows out of the product tank and into the casing, or where a casing is not provided, onto a draining floor, at atmospheric pressure under the force of gravity. As the remaining liquid product is drained from the product tank in this manner it tends to splash in the casing and becomes unsuitable for reuse. Specifically, the remaining product tends to foam and may become contaminated as it is drained from the product tank. Therefore, the remaining product is disposed of once it is drained from the system. Since packaging machines must be frequently cleaned, regularly disposing of the remaining product is costly.

SUMMARY OF THE INVENTION

A clean, automated product draining method for a packaging machine is set forth. The method includes the following steps: draining product from a product tank through a filling tube; and controlling a rate at which the product is drained from the product tank with a dispensing mechanism, wherein the product is drained at a slower rate than the rate at which the product is dispensed into a container during a production cycle.

Other objects and advantages of the present invention will become apparent upon reference to the accompanying detailed description when taken in conjunction with the following drawings.

DETAILED DESCRIPTION OF THE PREFERRED EMBODIMENT

Figure 1:
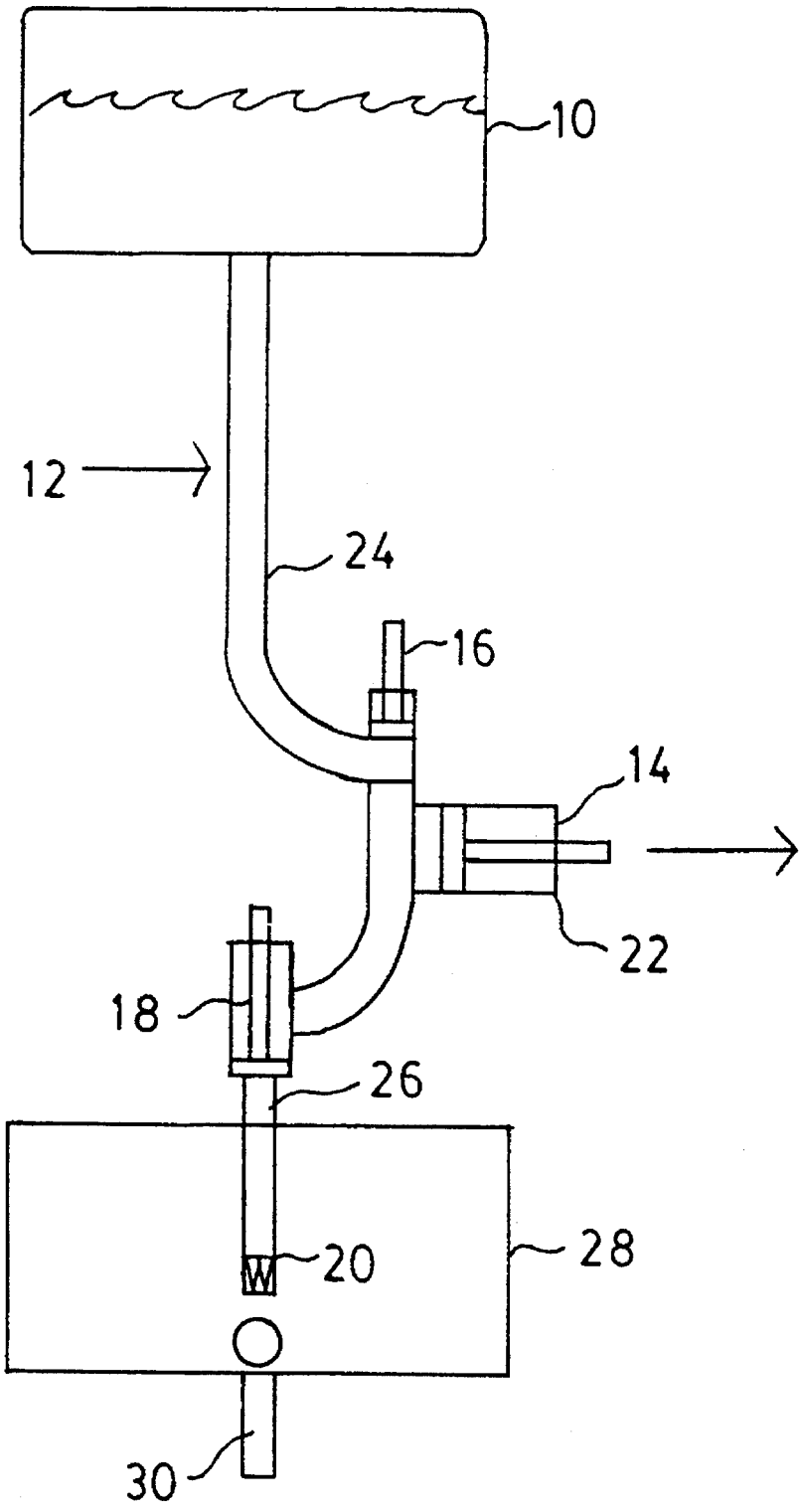
FIG. 1 illustrates the draining of product into an upper end of a filling tube in accordance with the disclosed method.

As illustrated in FIG. 1, product from a product tank 10 of a packaging machine can be drained from a filling tube 12. The rate, or flow at which the product is drained is controlled with a suitable dispensing mechanism, such as a pump 14, that, for example, may be a servomotor driven pump under control of a control system, such as is disclosed in U.S. Ser. No. 08/315,414, entitled "Control System for a Packaging Machine", filed on Sep. 28, 1994 and incorporated by reference. Where the pump 14 is used as the dispensing mechanism, inlet and outlet valves 16, 18 can be sequentially activated to assist in controlling the rate of flow at which the product is drained. In this case, the outlet valve 18 is disposed between the product tank 10 and a dispensing end 20 of the filling tube 12. The inlet valve 16 is disposed between the outlet valve 18 and the product tank 10. The pump 14 is disposed between the inlet valve 16 and the outlet valve 18. The method is then carded out as follows.

Figure 2:
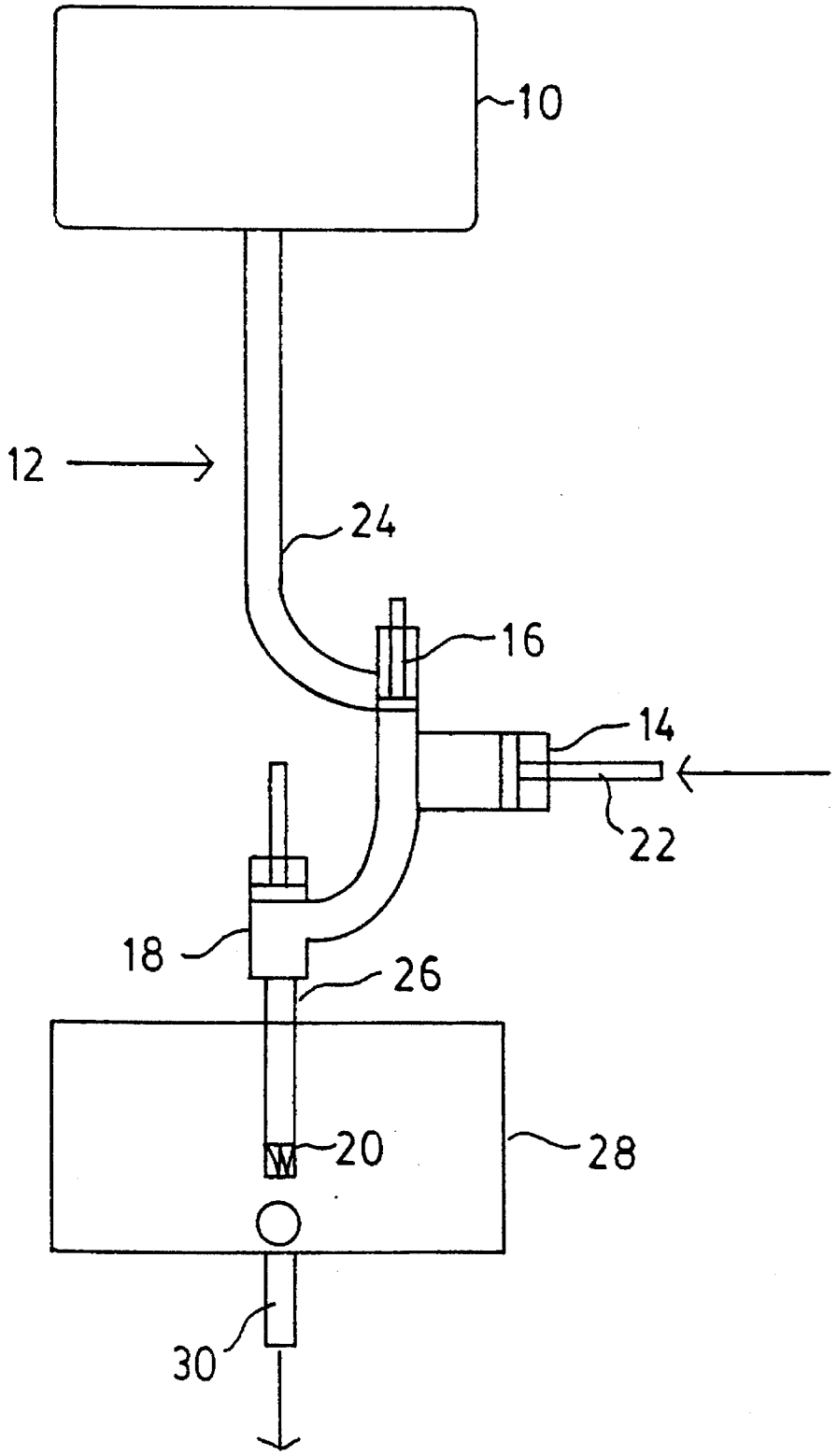
FIG. 2 illustrates the draining of product into a lower end of a filling tube in accordance with the disclosed method.

First, the outlet valve 18 is closed. Next, the inlet valve 16 is opened. A return stroke of a piston 22, as indicated by the arrow in FIG. 1, of the pump 14 is activated when or as the inlet valve 16 is opened. The product then drains into a region 24 of the filling tube 12 between the product tank 10 and the outlet valve 18. The inlet valve 16 is then closed, and then the outlet valve 18 is opened. As the outlet valve 18 is opened, a forward stoke of the piston 22, as indicated by the arrow in FIG. 2, is activated. The product then drains through a second region 26 of the filling tube 12 between the outlet valve 18 and the dispensing end 20 of the filling tube 12.

As the product drains out of the dispensing end 20 of the filling tube 12, the product must enter a clean draining environment, or it may become contaminated and unusable. As illustrated in FIGS. 1 and 2, the draining environment can include a clean chamber 28 formed by a cleaning box and a clean, automated cover as is discussed more fully in U.S. Ser. No. 08/316,109, entitled "AUTOMATED SEALING APPARATUS FOR A PACKAGING MACHINE", filed on even date herewith and incorporated by reference. A drain pipe 30 can be connected to, for example, a lower end of the clean chamber 28. The product can then drain into the clean chamber 28 and through the drain pipe 30. The illustrated system is a closed system that includes a vent pipe, such a system being disclosed in U.S. Ser. No. 08/315,958, entitled "TANK VENTING APPARATUS FOR A PACKAGING MACHINE", filed on even date herewith and hereby incorporated by reference.

In order to prevent the product from splashing as it enters the clean chamber 28, the pump 14 is operated at a slower rate than a rate at which the product is dispensed into a container during a production cycle. The slower rate can, for example, be 50% or less of the rate at which the product is dispensed. More specifically, the slower rate may be 10–25% of the rate at which the product is dispensed.

Figure 3:
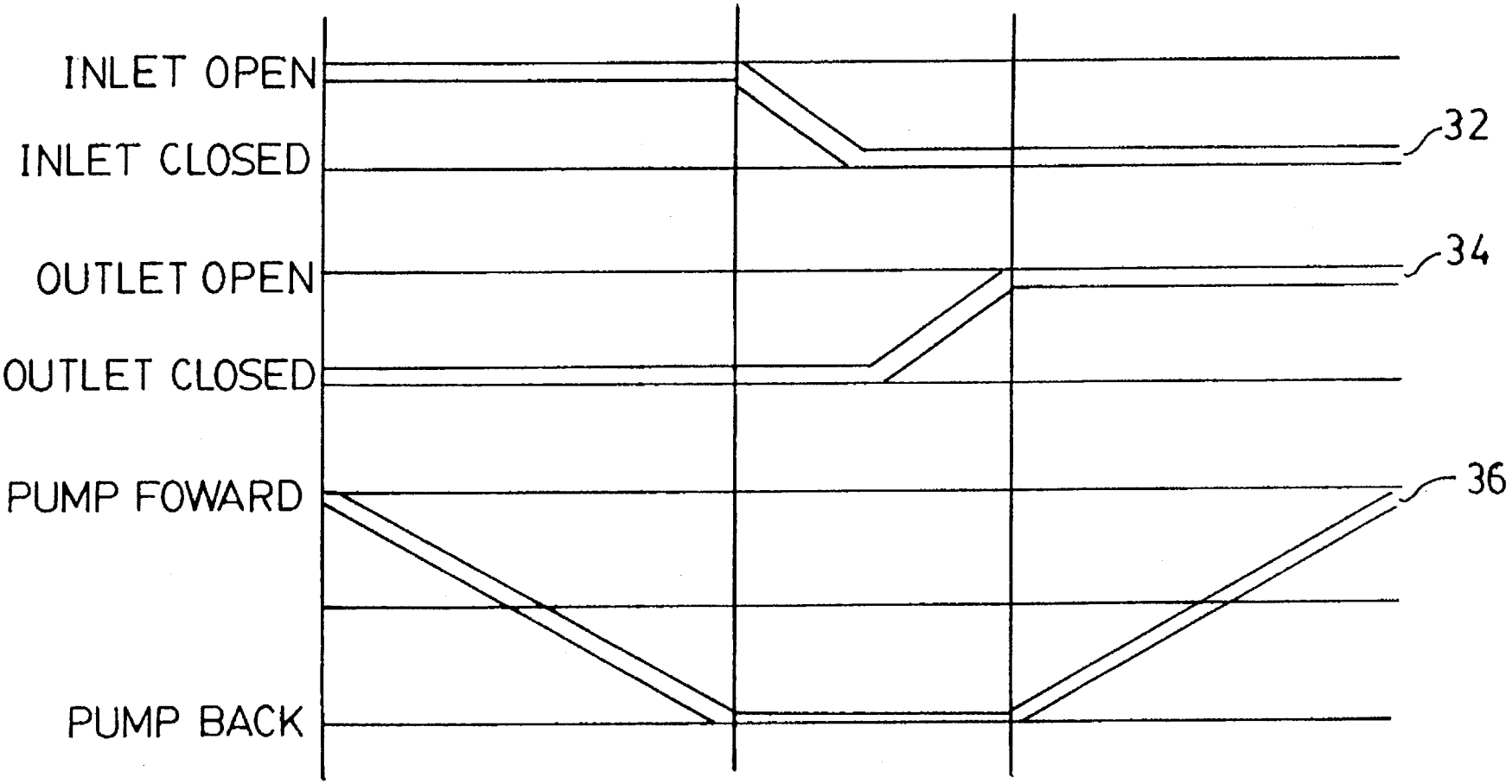
FIG. 3 illustrates graphically the controlling sequence for draining the product.

FIG. 3 is an exemplary timing diagram illustrating operation of the inlet valve 16, shown at line 32, the outlet valve 18, shown at line 34, and the pump 14, shown at line 36.

Figure 4:
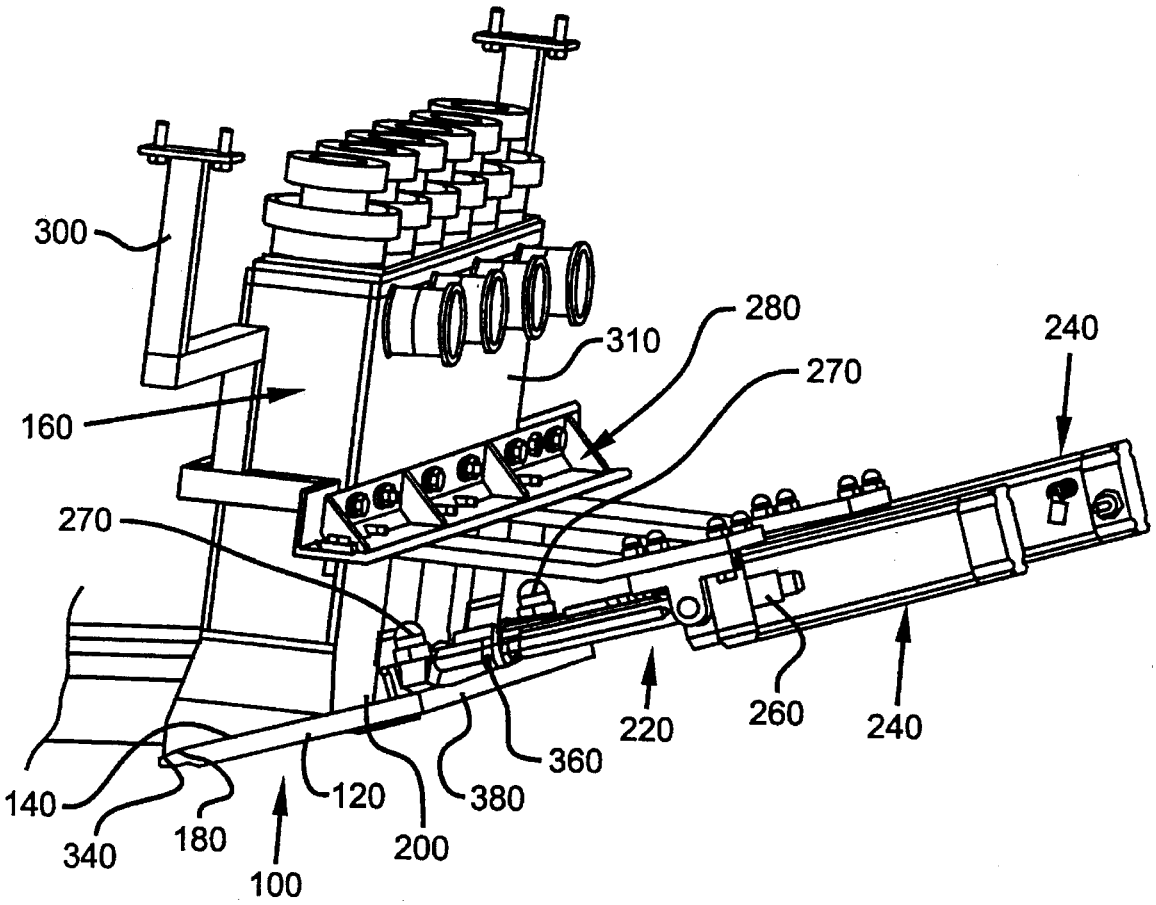
FIG. 4 is a perspective view of an automated sealing device wherein the sealing device is in a closed position and in sealing relationship with a cleaning box of a packaging machine.

FIG. 4 Illustrates an automated sealing device, shown generally at 100. The automated sealing device 100 Includes a retractable cover, or lid, 120. The retractable cover 120 is removably connected to an open end 140 of a cleaning box 160. The retractable cover 120 is maintained in a closed position and covers the open end 140 of the cleaning box 160, as illustrated in the FIG. 4, during both a product draining cycle and a cleaning cycle of a packaging machine.

The automated sealing device 100 further includes a suitable seal 180, such as a selectively actuable seal or an inflatable seal, provided on the retractable cover 120. The seal 180 is disposed in a suitable position on the retractable cover 120 such that a sealing engagement is achieved between the retractable cover 120 and the open end 140 of the cleaning box 160, such as on a top 200 of the retractable cover 120

A retracting assembly, shown generally at 220, is provided for selectively moving the retractable cover 120 from an open to the closed position shown in FIG. 1. The retracting assembly 220 includes a suitable retracting device 240, such as a pair of pneumatic cylinders, connected to the retractable cover 120. A position sensor 260 is also provided. The position sensor 260 is connected to the retracting device 240 with a suitable bracket (not shown). The position sensor 200 detects the position of the retracting device 240, i.e., whether the retracting device 24 is in an extended or retracted position. The position sensor 260 ensures reliable positioning of the retractable cover 120 by the automated sealing device 100. The retracting device 240 and sensor 260 may be controlled and sensed by, for example, an electronic control system. Gimbals 270 prevent lock-up of the pneumatic cylinders 240 as the cover is driven form its first to its second position.

The retracting assembly 220 is secured to the packaging machine in a suitable manner, such that reliable positioning of the retractable cover 120 with respect to the open end 140 of the cleaning box 160 is achieved. For example, the retracting assembly 220 can be secured to the cleaning box 160 by a frame 280 connected to a bracket 300 provided on an exterior wall 310 of the cleaning box 160, as illustrated in FIG. 4.

As the retracting assembly 220 is activated with the retractable cover 120 in an open position, the retractable cover 120 moves across the open end 140 of the cleaning box 160. Once the retractable cover 120 is in the closed position, the seal 180 prevents liquid, flowing through the cleaning box 160, from leaking out of the open end 140 of the cleaning box 160. If the seal 180 is selectively actuable or inflatable, then the seal 180 is actuated or inflated once the retractable cover 120 is in the closed.

Although the present invention has been described with reference to specific embodiments, those of skill in the art will recognize that changes may be made thereto without departing from the scope and spirit of the invention as set forth in the appended claims.

We claim as our invention:

1. A method for operating a packaging machine wherein the packaging machine comprises a fill pipe having a dispensing end disposed in a clean box and wherein the clean box comprises an opening end and an automatically retractable cover to automatically seal and open the opening end of the clean box, the method comprising the following steps:

(a) operating the packaging machine in a production cycle wherein a dispensing mechanism is used to dispense a product from a product tank into a production container through the dispensing end of the fill tube, the dispensing mechanism being operated at a production rate to dispense product into the production container;

(b) automatically moving the automatically retractable cover to close the opening end of the clean box; and (c) operating the packaging machine in a product drainage cycle wherein the dispensing mechanism is used to control draining of the product from the product tank through the dispensing end of the filling tube and into a clean chamber to control a rate of draining of the product into the clean chamber, the dispensing mechanism being operated to control product flow at a draining rate wherein the draining rate is slower than the production rate, the clean chamber being formed by the clean box disposed about the dispensing end of the fill tube and the automatically retractable cover.

2. A method according to claim 1 wherein the dispensing mechanism further comprises a pump disposed in-line between an inlet valve and an outlet valve, the inlet valve being disposed to control product flow between the product tank and the pump, the outlet valve being disposed to control product flow between the pump and the clean chamber, and wherein step (c) further comprises the following steps:

(1) sequentially closing the outlet valve and opening the inlet valve; and (2) activating a return stroke of a piston of the pump during step (1).

3. A method according to claim 2, further comprising the following step:

(3) draining product from the product tank into a region of a filling tube between the product tank and the outlet valve.

4. A method according to claim 3, further comprising the following step:

(4) closing the inlet valve.

5. A method according to claim 4, further comprising the following step:

(5) opening the outlet valve.

6. A method according to claim 5, further comprising the following step:

(6) activating a forward stroke of the piston during step (5).

7. A method according to claim 5, further comprising the following step:

(7) draining the product through a dispensing end of the filling tube.

8. A method according to claim 1, further comprising the step of:

draining the product from the clean chamber into a drain pipe.

9. A method according to claim 1 wherein the drainage rate is less than 50% of the production rate.

10. A method according to claim 1 wherein the draining rate is 10–25% of the production rate.

11. A method according to claim 1 and further comprising the step of draining the product from the clean box for re-use.

12. A method for operating a packaging machine wherein the packaging machine comprises a fill pipe having dispensing end disposed in a clean box and wherein the clean box comprises an opening end and a removable cover used to seal and open the opening end of the clean box, the method comprising the following steps:

(a) operating the packaging machine in a production cycle wherein a piston pump mechanism is controlled to dispense a product from a product tank into a production container through the dispensing end of a fill tube, the piston pump being operated at a production rate to dispense product into the production container;

(b) placing the retractable cover over the opening end of the clean box to seal opening end of the clean box and thereby define a clean chamber;

(c) operating the packaging machine in a drainage cycle wherein the piston pump is operated to control draining of the product from the product tank through the dispensing end of the filling tube and into the clean chamber to control a rate of draining of the product into the clean chamber, the piston pump being operated to control product flow at a draining rate wherein the draining rate is slower than the production rate; and (d) draining the product from the clean box for re-use.

13. A method according to claim 12 wherein the draining rate is less than 50% of the production rate.

14. A method according to claim 12 wherein the draining rate is 10–25% of the production rate.

* * * * *

UNITED STATES PATENT AND TRADEMARK OFFICE

CERTIFICATE OF CORRECTION

PATENT NO. : 5,584,324
DATED : December 17, 1996
INVENTOR(S) : Franke, et. al.

It is certified that error appears in the above-indentified patent and that said Letters Patent is hereby corrected as shown below:

IN COLUMN 3, LINE 12

Please cancel "Illustrates" and insert --illustrates-- therefor.

IN COLUMN 3, LINE 13

Cancel "Includes" and insert --includes-- therefor.

IN COLUMN 3, LINE 36

Cancel "200" and insert --260-- therefor.

IN COLUMN 4, LINE 64

Cancel "drainage" and insert --draining-- therefor.

Signed and Sealed this

Eighth Day of April, 1997

*Attest:*

Bruce Lehman

BRUCE LEHMAN

*Attesting Officer*

*Commissioner of Patents and Trademarks*